US009524685B2

(12) United States Patent
Kim et al.

(10) Patent No.: US 9,524,685 B2
(45) Date of Patent: Dec. 20, 2016

(54) DISPLAY APPARATUS AND METHOD FOR DRIVING THE SAME

(71) Applicant: BOE TECHNOLOGY GROUP CO., LTD., Beijing (CN)

(72) Inventors: Heecheol Kim, Beijing (CN); Song Young Suk, Beijing (CN); Yoo Seong Yeol, Beijing (CN); Im Yun Sik, Beijing (CN); Choi Seung Jin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 126 days.

(21) Appl. No.: 14/316,284

(22) Filed: Jun. 26, 2014

(65) Prior Publication Data

US 2015/0279296 A1 Oct. 1, 2015

(30) Foreign Application Priority Data

Mar. 25, 2014 (CN) ..... 2014 1 0114673

(51) Int. Cl.

*G09G 5/00* (2006.01)
*G09G 3/36* (2006.01)
*G09G 3/20* (2006.01)

(52) U.S. Cl.

CPC ..... *G09G 3/3618* (2013.01); *G09G 3/20* (2013.01); *G09G 3/2085* (2013.01);
(Continued)

(58) Field of Classification Search

CPC . G09G 3/20; G09G 2310/0297; G09G 3/3688
(Continued)

(56) References Cited

U.S. PATENT DOCUMENTS 5,686,936 A * 11/1997 Maekawa ..... G09G 3/3648 345/100
7,852,311 B2 * 12/2010 Hashimoto ..... G09G 3/3688 345/100
2002/0105492 A1 8/2002 Kosaka

FOREIGN PATENT DOCUMENTS

CN 1402215 A 3/2003
CN 1447302 A2 10/2003
CN 1697006 A 11/2005

OTHER PUBLICATIONS

First Office Action for CN Application No. 20140114673.X, dated Sep. 6, 2015, 6 pages.

* cited by examiner

*Primary Examiner* — Jonathan Blancha
(74) *Attorney, Agent, or Firm* — Kinney & Lange, P.A.

(57) ABSTRACT

The present invention relates to a display apparatus and a method for driving the same. The display apparatus comprises: a source driving circuit having at least one output; at least one pixel unit each including a plurality of sub-pixels, the respective sub-pixels in each pixel unit being connected to the same output of the source driving circuit by data lines, wherein a switch group is disposed in a data line connecting each sub-pixel with the output of the source driving circuit, each switch group including at least two switches parallel with each other; wherein the source driving circuit charges each pixel unit based on the on-off states of the respective switches between the source driving circuit and each pixel unit through a plurality of charging phases, wherein for one switch group corresponding to one of the sub-pixels in each pixel unit, each switch in the one switch group is respectively switched on in different charging phases to perform at least two times of charge on the one of the sub-pixels in at least two charging phases. The display apparatus and the
(Continued)

method for driving the same can increase charging time for each sub-pixel, thus avoiding a bad display due to insufficient charge of the sub-pixels.

10 Claims, 3 Drawing Sheets

(52) U.S. Cl.
CPC ... *G09G 3/3688* (2013.01); *G09G 2300/0426* (2013.01); *G09G 2310/0297* (2013.01)

(58) Field of Classification Search
USPC ..... 345/100, 98, 205; 14/100
See application file for complete search history.

DISPLAY APPARATUS AND METHOD FOR DRIVING THE SAME

This application claims the benefit of Chinese Patent Application No. 201410114673.X filed on Mar. 25, 2014 in the State Intellectual Property Office of China, the whole disclosure of which is incorporated herein by reference.

BACKGROUND OF THE INVENTION

Field of the Invention

Embodiments of the present invention relate to field of display technique, in particular to a display apparatus and a method for driving the same.

Description of the Related Art

In the field of display technique, especially the field of liquid crystal display, data signals of pixels in a display apparatus is provided by a source driving circuit such as a source driving chip IC.

The source driving IC in the existing display apparatus is provided with a plurality of signal output channels corresponding to a plurality of data lines respectively. When the thin film transistors which correspond to one row of pixels corresponding to one of the gate lines are simultaneously turned on, the data signal provided by each data line will charge a pixel electrode corresponding to each pixel. A charging time for each pixel in the row of pixels is the same and equal to a time in which the pixel is switched on.

As shown in FIG. 1, the source driving IC includes N data signal output channels each corresponding to one of the data lines D1 to Dn. The data signal output channels may output data signals corresponding to red pixels (R), green pixels (G), blue pixels (B) or other color pixels respectively. The N data signal output channels are simultaneously switched on to output the data signals, i.e, charge simultaneously the pixel electrodes corresponding to a gate line, and a charging time is equal to a time for controlling the transistor to be turned on by the gate line. For example, a switch-on time of the gate line is about 15 μs, and thus the time for charging each pixel is about 15 μs which is sufficient for charging each pixel completely. However, the source driving IC having the plurality of data signal output channels has a complicated structure a high cost, which is not in favor of obtaining a display apparatus with simple structure at a low cost.

In prior art, in order to solve the problem as described above, as shown in FIG. 2, a demultiplexer is provided between a source driving circuit 100 and data lines, and each output line of the demultiplexer is provided with a switch 300. For three sub-pixels in one pixel unit, the three sub-pixels are controlled by three switches to be charged in different time periods respectively. That is, the switch 300 is disposed between each of data lines D1, D2 and D3 and the source driving circuit 100, and each of the switches 300 controls a sub-pixel corresponding to one of the data lines to be charged. Assuming a time for charging the three sub-pixels in one pixel unit is set as 15 μs, as shown in FIG. 2, the three sub-pixels in one pixel unit are charged in three charging phases respectively. Since only one of the sub-pixels is charged in each charging phase, if the charging time for each pixel unit is 15 μs, the charging time for each sub-pixel is 5 μs, which is such a too short charging time and will result in a poor display.

SUMMARY OF THE INVENTION

The present invention has been made to overcome or alleviate at least one of the above mentioned disadvantages.

An object of embodiments of the present invention is to provide a display apparatus and a method for driving the same to avoid a bad display due to insufficient charge of pixels.

In an embodiment of an aspect of the present invention, there is provided a display apparatus comprising: a source driving circuit having at least one output; at least one pixel unit each including a plurality of sub-pixels, the sub-pixels in each pixel unit being connected to the same output of the source driving circuit by data lines, wherein a switch group is provided in each data line connecting each sub-pixel and the output of the source driving circuit, each switch group including at least two switches parallel with each other; wherein the source driving circuit charges each pixel unit based on the on-off states of the respective switches between the source driving circuit and the pixel unit though a plurality of charging phases, wherein for one switch group corresponding to one sub-pixel in each pixel unit, each switch in the one switch group is respectively switched on in at least two charging phases to perform at least two times of charges for the one sub-pixel in the at least two charging phases.

In an embodiment of another aspect of the present invention, there is provided a method for driving the above display apparatus according the one aspect of the present invention, the method comprising: charging each pixel unit by the source driving circuit based on the on-off states of the respective switches between the source driving circuit and the pixel unit through a plurality of charging phases, wherein one switch in the switch group corresponding to one sub-pixel is controlled to be switched on to transmit a data signal output from the source driving circuit to the one sub-pixel to perform a first charging for the one sub-pixel in one charging phase of each pixel unit; and another switch in the switch group corresponding to the one sub-pixel is controlled to be switched on to transmit a data signal output from the source driving circuit to the one sub-pixel to perform a second charging for the one sub-pixel in at least another one charging phase of the same pixel unit.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
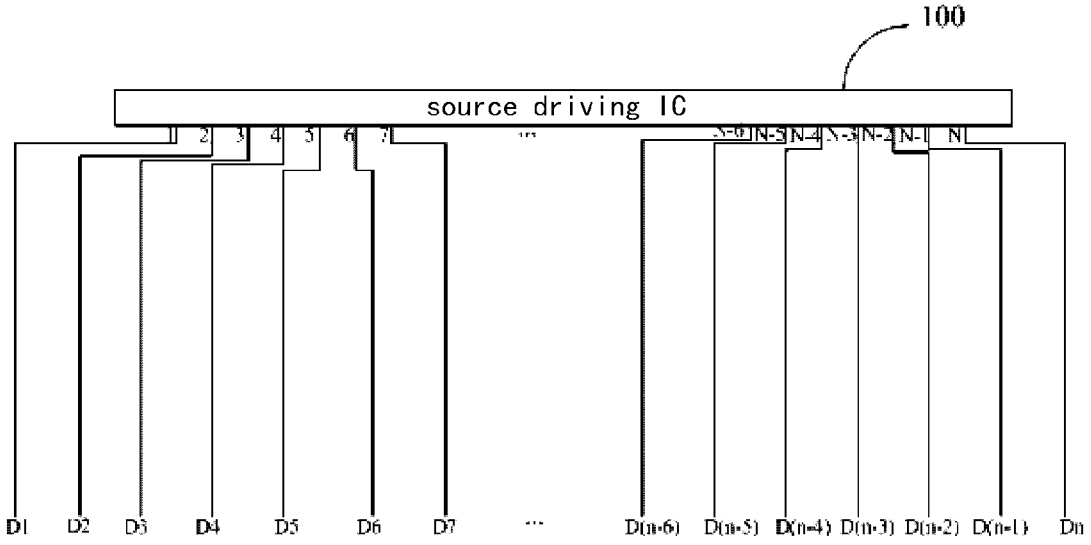
FIG. 1 is a schematic view showing a first connection relationship between a source driving IC and data lines in a display apparatus in prior art.
Figure 2:
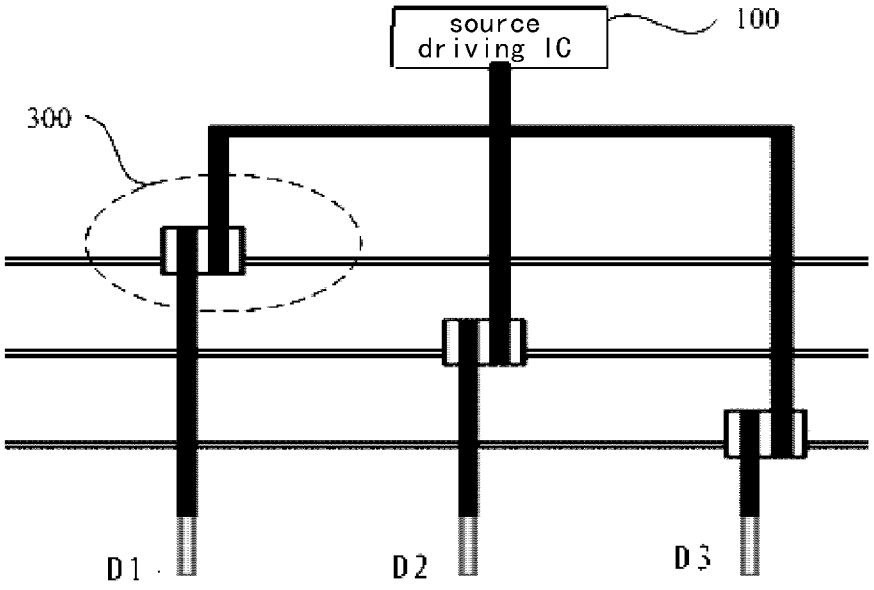
FIG. 2 is a schematic view showing a second connection relationship between a source driving IC and data lines in a display apparatus in prior art.

An exemplary embodiment of the present invention will be described below with reference to the accompanying drawings. In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
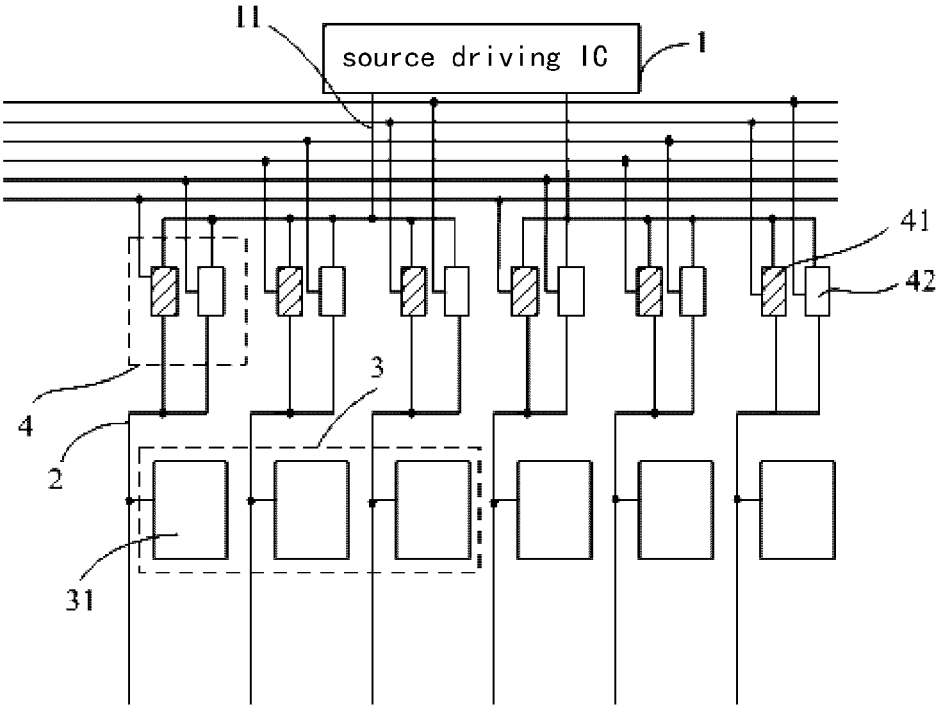
FIG. 3 is a schematic view of a display apparatus according to an exemplary embodiment of the present invention.

Referring to FIG. 3, a display apparatus according to an exemplary embodiment of the present invention comprises: a source driving circuit 1 having a plurality of outputs and a plurality of pixel units 3 each of which is connected to one of the outputs of the source driving circuit 1 by a plurality of data lines 2. Each pixel unit 3 includes a plurality of sub-pixels 31 which are connected with the same one output of the source driving circuit 1 by the plurality of data lines 2 respectively. For each pixel unit 3, each data line 2 connecting each sub-pixel 31 with one of outputs of the source driving circuit 1 is provided with a switch group 4 which includes two switches parallel with each other and referred as a first switch 41 and a second switch 42 hereafter.

In the display apparatus with the above structure, the source driving circuit 1 charges each of the pixel units 3 based on the on-off states of the switches 41, 42 between the source driving circuit 1 and the pixel unit 3 in three charging phases. For a switch group 4 corresponding to a first sub-pixel 31 in each of the pixel units 3, the first switch 41 in the switch group 4 is switched on in a first charging phase of its pixel unit 3, which is a pre-charging phase of the first sub-pixel, to transmit a data signal output from the source driving circuit 1 to the first sub-pixel 31 by a data line 2 so as to perform a first charging (a pre-charging) on the first sub-pixel 31. The second switch 42 in the switch group 4 is switched on in a second charging phase of its pixel unit 3 which is a primary charging phase of the first sub-pixel to transmit a data signal output from the source driving circuit 1 to the first sub-pixel 31 by a data line 2 so as to perform a second charging (a primary charging) on the first sub-pixel 31.

Similarly, for a switch group 4 corresponding to a second sub-pixel 31 in each of the pixel units 3, the first switch 41 in the switch group 4 is switched on in a second charging phase of its pixel unit 3 which is a pre-charging phase of the second sub-pixel to transmit a data signal output from the source driving circuit 1 to the second sub-pixel 31 by a data line 2 so as to perform a first charging (a pre-charging) on the second sub-pixel 31. The second switch 42 in the switch group 4 is switched on in a third charging phase of its pixel unit 3 which is a primary charging phase of the second sub-pixel to transmit a data signal output from the source driving circuit 1 to the second sub-pixel 31 by a data line 2 so as to perform a second charging (a primary charging) on the second sub-pixel 31.

Similarly, for a switch group 4 corresponding to a third sub-pixel 31 in each of the pixel units 3, the first switch 41 in the switch group 4 is switched on in a third charging phase of its pixel unit 3 which is a pre-charging phase of the third sub-pixel to transmit a data signal output from the source driving circuit 1 to the third sub-pixel 31 by a data lines 2 so as to perform a first charging (a pre-charging) on the third sub-pixel 31. The second switch 42 in the switch group 4 is switched on in a first charging phase of its pixel unit 3 which is a primary charging phase of the third sub-pixel to transmit a data signal output from the source driving circuit 1 to the second sub-pixel 31 by a data line 2 so as to perform a second charging (a primary charging) on the third sub-pixel 31.

Therefore, the source driving circuit 1 is configured to perform the primary charging on one of the sub-pixels in each of the pixel units while perform the pre-charging on another one of the sub-pixels in the pixel unit in each of the charging phases. Further, the source driving circuit 1 outputs a data signal corresponding to the sub-pixel on which the primary charging is performed during each charging phase.

Specifically, in each charging phase of one of the pixel units 3, two sub-pixels 31 are charged simultaneously by switching on the first switch 41 in the switch group 4 corresponding to one of the two sub-pixels 31 and the second switch 42 in the switch group 4 corresponding to the other of the two sub-pixels and switching off other switches in the one pixel unit. Further, the primary charging is performed on one of the two sub-pixels while the pre-charging is performed on the other of the two sub-pixels. That is, the source driving circuit 1 outputs the data signal corresponding to the sub-pixel on which the primary charging is performed.

In the display apparatus as shown in FIG. 3, the display apparatus is provided with the first and second switches for any one of data lines to be used in two charging phases respectively, and one of the sub-pixels is primarily charged while another one of the sub-pixels is pre-charged. In a case where the charging time for each pixel unit is fixedly prescribed, the charging time for each of the sub-pixels is increased by charging the sub-pixel twice, thereby avoiding a poor display of the display apparatus due to insufficient charging of the data lines or sub-pixels.

According to the present invention, since the charging of the respective sub-pixels 31 of the same pixel unit 3 are performed in different phases and the inputs of the respective first switches and the respective second switches corresponding to the same pixel unit are connected with the same output of the source driving circuit, it is possible to reduce the number of the outputs of the source driving circuit, thus simplifying the structure of the source driving circuit.

Figure 4:
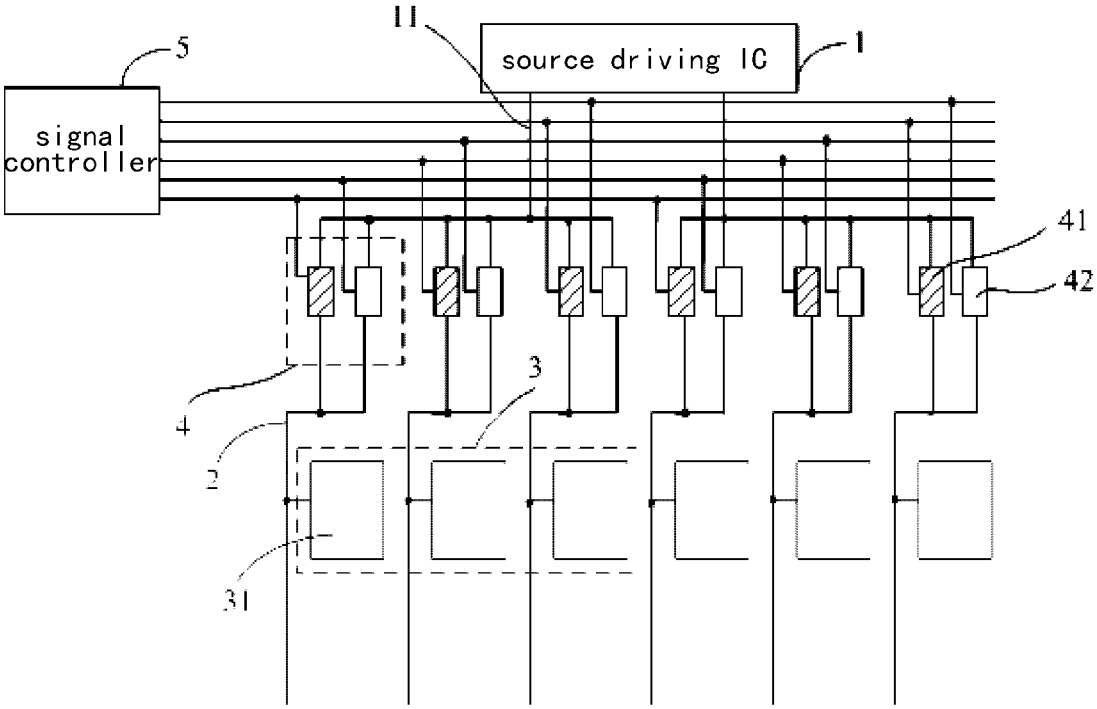
FIG. 4 is a schematic view of a display apparatus according to another exemplary embodiment of the present invention.

FIG. 4 shows a display apparatus according to another exemplary embodiment of the present invention. As compared with the embodiment shown in FIG. 3, the display apparatus shown in FIG. 4 further comprises a signal controller 5. The signal controller 5 includes a plurality of signal outputs which are connected with the control terminals of the first and second switches 41 and 42 corresponding to each pixel unit 3 respectively to control the second switches 42 to be switched on in turn, and when the second switch 42 corresponding to one of the sub-pixels 31 is switched on, the signal controller 5 controls the first switch 41 corresponding to another one of the sub-pixels 31 to be switched on simultaneously. That is, the signal controller 5 performs control so that the second switch 42 corresponding to one of the sub-pixels 31 and the first switch 41 corresponding to another one of the sub-pixels 31 are switched on simultaneously.

Further, as shown in FIG. 4, the same signal output of the signal controller 5 is connected to the corresponding switches of different pixel units so as to control the plurality of pixel units 3 synchronously.

It is noted that only one of the first switches and one of the second switches are switched on and the remaining first and second switches are switched off during each charging stage.

An electrical connection between lead wires is denoted by a small black spot in FIGS. 3 and 4.

As shown in FIGS. 3 and 4, a type of the first and second switches 41 and 42 is not limited, and for example may be a thin film transistor (TFT) which is simple in structure and easy to manufacture.

Although not shown in FIGS. 3 and 4, the display apparatus may further comprise gate lines for controlling the charge of the sub-pixels, and a plurality of gate lines and a plurality of data lines encircle the plurality of sub-pixel units.

According to embodiments of the present invention, the first switch may be the same as the second switch in structure, and they differs only in that controlling signals for controlling the first and second switches to be switched on and off are different.

According to the display apparatus as shown in FIG. 4, one of the data lines is controlled by two switches, and each of the sub-pixels is charged in two charging phases of its pixel unit. For example, the primary charging phase of each of the sub-pixels 31 is controlled by the second switch 42, and the pre-charging phase thereof is controlled by the first switch 41. The signal controller 5 controls the second switches 42 in the respective switch groups 4 to be switched on in different charging phases in turn, so that the sub-pixels connected with the second switches 42 by data lines are charged in turn.

As shown in FIG. 4, when the signal controller 5 controls the second switch 42 in one of the switch groups 4 in each pixel unit 3 to be switched on, the first switch 41 in another one of switch groups 4 in the same pixel unit 3 is controlled to be switched on, thereby achieving the primary charging of one of the sub-pixels and the pre-charging of another one of the sub-pixels simultaneously. Therefore, it is possible to increase the charging time for each of the sub-pixels without changing the time for charging each pixel unit. For example, assuming the primary charging time is set as m μs, the precharging time is set as n μs, the total charging time for each of the sub-pixels is (m+n) μs. The numerical value m may be the same as or different from the numerical value n. As a specific example, assuming a time for charging three sub-pixels in one of the pixel units is set as 15 μs, i.e., the charging time for each of the pixel units is 15 μs, in prior art, since only one switch is provided between one of the data lines and the source driving circuit and the switch controls the one of the data lines to perform the charge, the time for charging each of the sub-pixels is 5 μs; however, a time for charging each of the sub-pixels may be as long as 10 μs in the present invention.

In the display apparatus as shown in FIG. 4, the source driving circuit 1 is connected with the switch groups 4 by output leading lines 11. One of outputs corresponds to one of the output leading lines 11.

Specifically, each of the output leading lines 11 is connected with the inputs of the first and second switches 41 and 42. The outputs of the first and second switches 41 and 42 are connected with the data lines. The control terminals of the first and second switches 41 and 42 are connected with the signal controller 5. The data signals output from the source driving circuit 1 are transmitted to respective first and second switches 41 and 42 by the output leading lines 11, and the first and second switches 41 and 42 are controlled to be switched on or off by the signal controller 5. When the first switch 41 or the second switch 42 is switched on, the data signal is input to the data line to charge the pixel unit.

Specifically, the source driving circuit 1 includes a plurality of output leading lines 11 each corresponding to one or more pixel units in the display apparatus to charge the one or more pixel units.

For example, each output of the source driving circuit 1 may be correspond to and connected with one pixel unit by the switch group respectively.

Referring to FIGS. 3 and 4, each of the output leading lines 11 is connected with the plurality of switch groups 4, particularly with the first and second switches 41 and 42 in each of the switch groups 4.

It is noted that a structure formed by connecting the respective switch groups 4 with one of the output leading lines may be referred to as a demultiplexer (DMUX) or constitutes a part of circuit of the demultiplexer.

According to another embodiment of the present invention, each of the output leading lines may be connected with several switch groups according to actual requirements, and the number of the connected switch groups is equal to that of the sub-pixels in a pixel unit.

According to another embodiment of the present invention, the number of the switch groups connected with each output leading line is in a range of 2 to 6. That is, each of the pixel units includes 2 to 6 sub-pixels.

For example, when one of the pixel units includes three sub-pixels such as a red sub-pixel, a green sub-pixel and a blue sub-pixel, each of the sub-pixels is connected with one of the switch groups by one of the data lines. At this time, three switch groups are connected with each of the output leading lines to constitute a structure referred to as a three-way demultiplexer DMUX, which has six charging channels corresponding to three charging phases. During each of the three charging phases, the data signals are output only through two charging channels to perform the primary charging of one of the sub-pixels and the pre-charging of another one of sub-pixels.

When one of the pixel units includes four sub-pixels such as a red sub-pixel, a green sub-pixel, a blue sub-pixel and a white sub-pixel, each of the sub-pixels is connected with one of the switch groups by one of the data lines. At this time, four switch groups are connected with each of the output leading lines to constitute a structure referred to also as a four-way demultiplexer DMUX which has eight charging channels corresponding to four charging phases. During each of the four charging phases, the data signals are output respectively only through two charging channels to perform the primary charging of one of the sub-pixels and the pre-charging of another one of the sub-pixels in each of the four charging phases.

When one of the pixel units includes six sub-pixels, each of the sub-pixels is connected with one of the switch groups by one of the data lines. At this time, six switch groups are connected with each of the output leading lines to constitute a structure also be referred to as a six-way demultiplexer DMUX which has twelve charging channels corresponding to six charging phases. During each of the six charging phases, the data signals are output respectively only through two charging channels to perform the primary charging of one of the sub-pixels and the pre-charging of another one of the sub-pixels.

According to another embodiment of the present invention, the number of the switches in each of the switch groups is not limited to two. For example, each of the switch groups may include three or more switches. In this way, each of the sub-pixels may be performed several times of charges in different charging phases by several switches in the corresponding switch group as required to increase the charging time for each of the sub-pixels.

In the display apparatus according to another embodiment of the present invention, the source driving circuit 1 may include any number of outputs and/or any number of pixel units.

Figure 5:
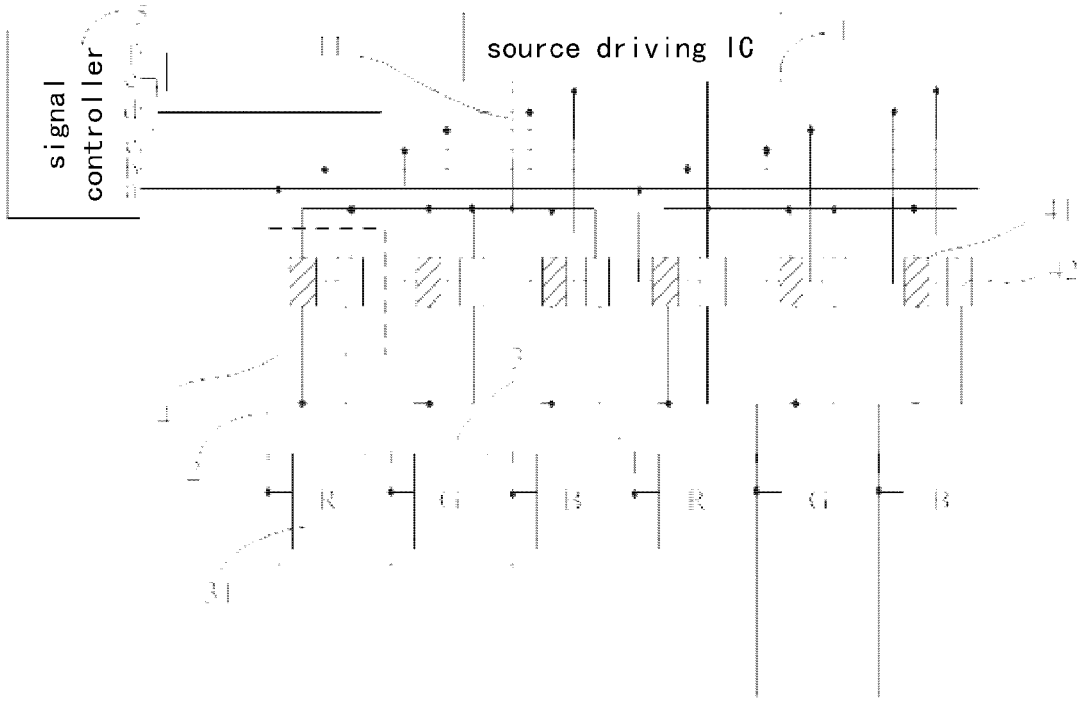
FIG. 5 is a schematic view of a display apparatus according to another exemplary embodiment of the present invention.

FIG. 5 shows a display apparatus according to an exemplary embodiment of the present invention. Referring to FIG. 5, an example will be described below in which one of the pixel units includes a red sub-pixel (R), a green sub-pixel (G) and a blue sub-pixel (B).

As shown in FIG. 5, three switch groups 4 are connected with each of the output leading lines 11. That is, the demultiplexer DMUX includes three switch groups 4.

According to the embodiment, in the switch group 4 corresponding to the red sub-pixel R, the outputs of the first and second switches 41 and 42 are connected with a drain of a thin film transistor (not shown in FIG. 5) in the red sub-pixel R.

In the switch group 4 corresponding to the green sub-pixel G, the outputs of the first and second switches 41 and 42 are connected with a drain of a thin film transistor in the green sub-pixel G.

In the switch group 4 corresponding to the blue sub-pixel B, the outputs of the first and second switches 41 and 42 are connected with a drain of a thin film transistor in the blue sub-pixel B.

Further, referring to FIG. 5, the signal controller 5 includes six signal outputs in which a first signal output a and a second signal output b are respectively connected with control terminals of the first and second switches 41 and 42 corresponding to the red sub-pixel R, a third signal output c and a fourth signal output d are respectively connected with control terminals of the first and second switches 41 and 42 corresponding to the green sub-pixel G, and a fifth signal output e and a sixth signal output f are respectively connected with control terminals of the first and second switches 41 and 42 corresponding to the blue sub-pixel B.

If the first and second switches 41 and 42 are film thin transistors, the control terminals thereof are gates of the thin film transistors respectively, and outputs and inputs thereof are sources and drains of the thin film transistors respectively.

If the pixel unit has a charging time of 15 μs, with the configuration as shown in FIG. 5, because the signal controller 5 controls the second switch 42 in one of the switch groups 4 of each of the pixel units to be switched on and simultaneously control the first switch 41 in another one of the switch groups 4 of the same pixel unit to be switched on, one of the sub-pixels in the pixel unit is charged while another one of the sub-pixels in the same pixel unit is pre-charged at the same time. Assuming a time for charging the three sub-pixels in one of the pixel units is set as 15 μs, and the charging time for each of the sub-pixel is 5 μs. Since one of the sub-pixels is primarily charged while another one of the sub-pixels is pre-charged, each sub-pixel is charged twice in different charging phases, and the charging time is 5 μs in each charging phase, and a total charging time is 10 μs. That is, the charging time for each of the red sub-pixel (R), the green sub-pixel (G) and the blue sub-pixel (B) is 10 μs respectively.

The display apparatus according to the embodiments of the present invention may be a liquid crystal panel, a liquid crystal display, a liquid crystal television, an organic light-emitting display (OLED) panel, an OLED display, an OLED television, an electronic paper or the like.

According to an exemplary embodiment of the present invention, there is also provided a method for driving the display apparatus according to the above embodiments, the method comprising:

charging each of pixel units by a source driving circuit according to the on-off states of the respective switches through a plurality of charging phases, wherein one of the switches in a switch group of one of sub-pixels is controlled to be switched on to transmit a data signal output from the source driving circuit to the sub-pixel to perform a first charging on the sub-pixel in one of the charging phases of each of the pixel units, and wherein another one of the switches in the switch group of the one of sub-pixels is controlled to be switched on to transmit a data signal output from the source driving circuit to the sub-pixel to perform a second charging on the sub-pixel in at least another one of the charging phases of the same pixel unit.

In each of the charging phases, one of the sub-pixels in each of the pixel units is primarily charged, and at least another one of the sub-pixels in the pixel unit is pre-charged. The source driving circuit outputs the data signal corresponding to the sub-pixel being primarily charged during each charging phase.

Specifically, one of the switches in the switch group of one of the sub-pixels and one of the switches in the switch group of another one of the sub-pixels in each pixel unit are controlled to be switched on simultaneously in each of the charging phases.

According to an exemplary embodiment, each of the pixel units includes a red sub-pixel, a green sub-pixel and a blue sub-pixel. Each of the switch groups includes first and second switches. The method further comprises:

controlling the first switch connected with the red sub-pixel and the second switch connected with the blue sub-pixel to be switched on in a first charging phase of the charging phases of one of the pixel units;

controlling the second switch connected with the red sub-pixel and the first switch connected with the green sub-pixel to be switched on in a second charging phase of the charging phases of the one of the pixel units; and controlling the second switch connected with the green sub-pixel and the first switch connected with the blue sub-pixel to be switched on in a third charging phase of the charging phases of the one of the pixel units.

Figure 6:
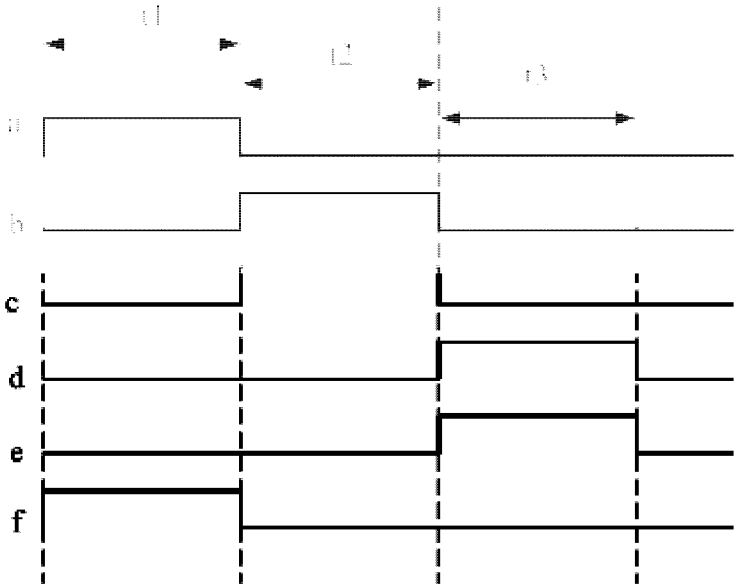
FIG. 6 is a timing diagram of voltage signals output from control terminals a to f of a signal controller and reflecting high and low voltage levels.

FIG. 6 is a timing diagram of a voltage signal output from control terminals a to f of the signal controller in FIG. 5 and reflecting high and low voltage levels.

Refer to FIG. 6, an example will be described below in which the first and second switches 41 and 42 are N-type thin film transistors which are turned on when being driven at a high level and turned off when being driven at a low level.

Six timing signals in FIG. 6 correspond to voltage signals output from the control terminals a to f and reflecting high and low levels respectively.

In a first time period t1, the signal controller controls the first switch connected with the red sub-pixel to be switched on through a high level signal output from the control terminal a, and controls the second switch connected with the blue sub-pixel to be switched on through a high level signal output from the control terminal f. In other time periods, the signal controller controls the first switch connected with the red sub-pixel and the second switch connected with the blue sub-pixel to be switched off through low level signals output from the control terminals a and f.

In a second time period t2, the signal controller controls the second switch connected with the red sub-pixel to be switched on through a high level signal output from the control terminal b, and controls the first switch connected with the green sub-pixel to be switched on through a high level signal output from the control terminal c. In other time periods, the signal controller controls the second switch connected with the red sub-pixel and the first switch connected with the green sub-pixel to be switched off through low level signals output from the control terminals b and c.

In a third time period t3, the signal controller controls the second switch connected with the green sub-pixel to be switched on through a high level signal output from the control terminal d, and controls the first switch connected with the blue sub-pixel to be switched on through a high level signal output from the control terminal e. In other time periods, the signal controller controls the second switch connected with the green sub-pixel and the first switch connected with the blue sub-pixel to be switched off through low level signals output from the control terminals d and e.

The charging time for the red sub-pixel is t1+t2, the charging time for the green sub-pixel is t2+t3, and the charging time for the blue sub-pixel is t3+t1.

A total charging time for the red, green and blue sub-pixels is t1+t2+t3.

According to the present invention, as described in the above embodiments, the source driving circuit charges each of the pixel units by data lines in several charging phases. For one switch group corresponding to one of sub-pixels in each pixel unit, each of switches in the switch group is switched on respectively in different charging phases so that the sub-pixel is charged at least twice in at least two charging phases.

Specifically, the display apparatus is provided with a plurality of switches corresponding to any one of data lines for charging in several charging phases respectively. Through controlling the respective switches to be switched on and off, one of the data lines is charged simultaneously as another data line is charged so as to increase the charging time for each of the data lines, thus avoiding a bad display due to insufficient charge of the sub-pixels.

Further, the signal controller controls one of the switches in one of the switch groups in each pixel unit to be switched on simultaneously as controlling another one of the switches in another one of the switch groups in the same pixel unit to be switched on, thus performing the primary charging of one data line (sub-pixel) and the pre-charging of another data line (sub-pixel) simultaneously. Therefore, the charging time for each of the sub-pixels is increased without changing the time for charging each of the pixel units, thus avoiding the bad display of the display apparatus due to insufficient charge of the sub-pixels.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A display apparatus comprising:

a source driving circuit having at least one output;

at least one pixel unit each including a plurality of sub-pixels, the respective sub-pixels of each pixel unit being connected to the same output of the source driving circuit by respective data lines, wherein a switch group is disposed in the data line connecting each sub-pixel with the output of the source driving circuit, and each switch group includes at least two switches parallel with each other;

wherein the source driving circuit charges each pixel unit based on on-off states of the respective switches between the source driving circuit and the pixel unit through a plurality of charging phases, wherein for one of the switch groups corresponding to one of the sub-pixels in each pixel unit, each switch in the one of the switch groups is respectively switched on in different charging phases respectively to perform at least two times of charging on the one of the sub-pixels in at least two charging phases;

wherein each of the pixel units is configured to include a red sub-pixel, a green sub-pixel and a blue sub-pixel, and each switch group is configured to include first and second switches; and wherein the first and second switches are configured to be controlled during the charging of each pixel unit such that:

the first switch connected with the red sub-pixel and the second switch connected with the blue sub-pixel are switched on in a first charging phase;

the second switch connected with the red sub-pixel and the first switch connected with the green sub-pixel are switched on in a second charging phase; and the second switch connected with the green sub-pixel and the first switch connected with the blue sub-pixel are switched on in a third charging phase.

2. The display apparatus according to claim 1, wherein the source driving circuit is configured to perform a primary charging on one of the sub-pixels in each pixel unit while simultaneously performing a pre-charging on at least another one of the sub-pixels in the pixel unit in each charging phase, and the source driving circuit outputs a data signal corresponding to the sub-pixel on which the primary charging is being performed during each charging phase.

3. The display apparatus according to claim 2, further comprising:

a signal controller including a plurality of signal outputs, each connected with a control terminal of one of the plurality of switches corresponding to each pixel unit correspondingly to control one of the switches in the switch group corresponding to one of the sub-pixels and one of the switches in the switch group corresponding to another one of the sub-pixels in each pixel unit to be simultaneously switched on in each charging phase.

4. The display apparatus according to claim 3, wherein the same signal output is connected to the corresponding switches of different pixel units.

5. The display apparatus according to claim 3, wherein, the outputs of the first and second switches in the switch group corresponding to the red sub-pixel are connected with a drain of a thin film transistor in the red sub-pixel, the outputs of the first and second switches in the switch group corresponding to the green sub-pixel are connected with a drain of a thin film transistor in the green sub-pixel; and the outputs of the first and second switches in the switch group corresponding to the blue sub-pixel are connected with a drain of a thin film transistor in the blue sub-pixel.

6. The display apparatus according to claim 5, wherein the signal controller includes six signal outputs including first to sixth signal outputs, the first and second signal outputs are connected with the control terminals of the first and second switches corresponding to the red sub-pixel respectively;

the third and fourth signal outputs are connected with the control terminals of the first and second switches corresponding to the green sub-pixel respectively; and the fifth and sixth signal outputs are connected with the control terminals of the first and second switches corresponding to the blue sub-pixel respectively.

7. The display apparatus according to claim 1, wherein the first and second switches are thin film transistors.

8. A method for driving a display apparatus that includes a source driving circuit having at least one output, and at least one pixel unit each including a plurality of sub-pixels, the respective sub-pixels of each pixel unit being connected to the same output of the source driving circuit by respective data lines, wherein a switch group is disposed in the data line connecting each sub-pixel with the output of the source driving circuit, and each switch group includes at least two switches parallel with each other, and wherein each of the pixel units is configured to include a red sub-pixel, a green sub-pixel and a blue sub-pixel, and each switch group is configured to include first and second switches;

wherein the method comprises:

charging each pixel unit by the source driving circuit based on the on-off states of the respective switches corresponding to the pixel unit through a plurality of charging phases, wherein the method further comprises:

controlling one of the switches in the switch group corresponding to one of the sub-pixels to be switched on to transmit a data signal output from the source driving circuit to the one of the sub-pixels to perform a first charging on the one of the sub-pixels in one of the charging phases of each pixel unit; and controlling another one of the switches in the switch group corresponding to the one of the sub-pixels to be switched on to transmit a data signal output from the source driving circuit to the one of the sub-pixels to perform a second charging on the one of the sub-pixels in at least another one of charging phases of the same pixel unit; and wherein during the charging of each pixel unit, the method further comprises:

controlling the first switch connected with the red sub-pixel and the second switch connected with the blue sub-pixel to be switched on in a first charging phase;

controlling the second switch connected with the red-sub-pixel and the first switch connected with the green sub-pixel to be switched on in a second charging phase; and controlling the second switch connected with the green sub-pixel and the first switch connected with the blue sub-pixel to be switched on in a third charging phase.

9. The method according to claim 8, further comprising:

performing a primary charging on one of the sub-pixels in each pixel unit while simultaneously performing a pre-charging on at least another one of the sub-pixels in the pixel unit in each charging phase, and during each charging phase, the source driving circuit outputs a data signal corresponding to the sub-pixel on which the primary charging is being performed.

10. The method of claim 8, wherein the respective pixel units are synchronously controlled.

* * * * *